US006101716A

United States Patent [19]

Schulz

[11] Patent Number: 6,101,716

[45] Date of Patent: Aug. 15, 2000

[54] EVAPORATIVE COOLER SOLAR RETROFIT KIT

[76] Inventor: Steven L. Schulz, P.O. Box 26106, Los Angeles, Calif. 90026-0106

[21] Appl. No.: 09/022,681

[22] Filed: Feb. 12, 1998

[51] Int. Cl.[7] ..... B23P 15/26

[52] U.S. Cl. ..... 29/890.033; 29/890.07; 29/401.1

[58] Field of Search ..... 29/890.033, 890.07, 29/401.1

[56] References Cited

U.S. PATENT DOCUMENTS

| | | | |
|---|---|---|---|
| 4,483,321 | 11/1984 | Sharpe | 29/890.033 |
| 4,586,227 | 5/1986 | Cornell | 29/890.033 |
| 4,667,653 | 5/1987 | Cornell | 29/890.033 |
| 5,488,801 | 2/1996 | Nix | 29/401.1 |

*Primary Examiner*—I Cuda

[57] ABSTRACT

A new evaporative cooler solar retrofit kit for taking an evaporative cooler off of an electrical power grid, thus reducing the amount of electrical power supplied by such a grid, and reducing the cost of operating such a cooler. The inventive device includes a solar panel which is mountable on the housing of the evaporative cooler, a dc motor for replacing the existing blower motor, and a dc motor driven pump for replacing the existing pump motor and pump. The solar panel is electrically coupled to the dc motor and to the dc motor driven pump, such that the electricity generated by the solar panel provides the electricity for operating the evaporative cooler. Therefore, the cooler utilizes energy provided by sunlight, which reduces the use of commercially supplied energy. The cooler will operate from sunrise to sunset when air cooling is most required.

7 Claims, 2 Drawing Sheets

EVAPORATIVE COOLER SOLAR RETROFIT KIT

BACKGROUND OF THE INVENTION

1. Field of the Invention

The present invention relates to cooling systems and more particularly pertains to a new evaporative cooler solar retrofit kit for taking an evaporative cooler off of an electrical power grid, thus reducing the amount of electrical power supplied by such a grid and reducing the cost of operating such a cooler.

2. Description of the Prior Art

The use of cooling systems is known in the prior art. More specifically, cooling systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art cooling systems include U.S. Pat. No. 5,046,329; U.S. Pat. No. 4,222,244; U.S. Pat. No. 4,376,435; and U.S. Pat. No. 4,739,620. In addition, U.S. Pat. No. 4,433,544 discloses a solar powered energy producing device.

Evaporative coolers themselves are well known. Such coolers operate by drawing air across water soaked pads and the process, drop the temperature of the resulting air-water vapor mixture. They have been developed and used to a high degree in the Southwest of the United States since they are much less expensive when compared with conventional space air conditioners. Evaporative coolers generally consist of a cube shaped housing with a blower inside the housing. The housing includes louver type openings which allow air to pass inside the housing when the blower is operated. Adjacent the louver openings, and inside the housing, are pads, which in use, are soaked with water. A water cooling system is provided inside the housing for soaking the pads, and for gathering and circulating the water within the water cooling system. A water pump, which is powered by electricity from an existing household line, is used to circulate the water. The motor for driving the blower is also powered from electricity from the same line.

Additionally, evaporative coolers generally divide into two main groups, a side-draft type and a down-draft type. In a side-draft evaporative cooler, the duct directing air from the housing extends through one of the side walls of the housing, while in a down-draft type, the duct extends downward through the bottom of the housing. Further details on the structure and operation of evaporative coolers can be found in U.S. Pat. No. 5,042,270, the entire disclosure of which is hereby incorporated by reference.

While these devices fulfill their respective, particular objectives and requirements, the aforementioned patents do not disclose a new evaporative cooler solar retrofit kit. The inventive device includes a solar panel which is mountable on the housing of the evaporative cooler, a dc motor for replacing the existing blower motor, and a dc motor driven pump for replacing the existing pump motor and pump. The solar panel is electrically coupled to the dc motor and to the dc motor driven pump, such that the electricity generated by the solar panel provides the electricity for operating the evaporative cooler. Therefore, the cooler utilizes energy provided by sunlight, which reduces the use of commercially supplied energy. The cooler will operate from sunrise to sunset when air cooling is most required.

In these respects, the evaporative cooler solar retrofit kit according to the present invention substantially departs from the conventional concepts and designs of the prior art, and in so doing provides an apparatus primarily developed for the purpose of taking an evaporative cooler off of an electrical power grid, thus reducing the amount of electrical power supplied by such a grid, and reducing the cost of operating such a cooler.

SUMMARY OF THE INVENTION

In view of the foregoing disadvantages inherent in the known types of cooling systems now present in the prior art, the present invention provides a new evaporative cooler solar retrofit kit construction wherein the same can be utilized for taking an evaporative cooler off of an electrical power grid, thus reducing the amount of electrical power supplied by such a grid, and reducing the cost of operating such a cooler.

The general purpose of the present invention, which will be described subsequently in greater detail, is to provide a new evaporative cooler solar retrofit kit and method which has many of the advantages of the cooling systems mentioned heretofore and many novel features that result in a new evaporative cooler solar retrofit kit which is not anticipated, rendered obvious, suggested, or even implied by any of the prior art cooling systems, either alone or in any combination thereof.

To attain this, the present invention generally comprises a solar panel which is mountable on the housing of the evaporative cooler, a dc motor for replacing the existing blower motor, and a dc motor driven pump for replacing the existing pump motor and pump. The solar panel is electrically coupled to the dc motor and to the dc motor driven pump, such that the electricity generated by the solar panel provides the electricity for operating the evaporative cooler. Therefore, the cooler utilizes energy provided by sunlight, which reduces the use of commercially supplied energy. The cooler will operate from sunrise to sunset when air cooling is most required.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new evaporative cooler solar retrofit kit and method which has many of the advantages of the cooling systems mentioned heretofore and many novel features that result in a new evaporative cooler solar retrofit kit which is not anticipated, rendered obvious, suggested, or even implied by any of the prior art cooling systems, either alone or in any combination thereof.

It is another object of the present invention to provide a new evaporative cooler solar retrofit kit which may be easily and efficiently manufactured and marketed.

It is a further object of the present invention to provide a new evaporative cooler solar retrofit kit which is of a durable and reliable construction.

An even further object of the present invention is to provide a new evaporative cooler solar retrofit kit which is susceptible of a low cost of manufacture with regard to both materials and labor, and which accordingly is then susceptible of low prices of sale to the consuming public, thereby making such evaporative cooler solar retrofit kit economically available to the buying public.

Still yet another object of the present invention is to provide a new evaporative cooler solar retrofit kit which provides in the apparatuses and methods of the prior art some of the advantages thereof, while simultaneously overcoming some of the disadvantages normally associated therewith.

Still another object of the present invention is to provide a new evaporative cooler solar retrofit kit for taking an evaporative cooler off of an electrical power grid, thus reducing the amount of electrical power supplied by such a grid, and reducing the cost of operating such a cooler.

Yet another object of the present invention is to provide a new evaporative cooler solar retrofit kit which includes a solar panel which is mountable on the housing of the evaporative cooler, a dc motor for replacing the existing blower motor, and a dc motor driven pump for replacing the existing pump motor and pump. The solar panel is electrically coupled to the dc motor and to the dc motor driven pump, such that the electricity generated by the solar panel provides the electricity for operating the evaporative cooler. Therefore, the cooler utilizes energy provided by sunlight, which reduces the use of commercially supplied energy. The cooler will operate from sunrise to sunset when air cooling is most required.

Still yet another object of the present invention is to provide a new evaporative cooler solar retrofit kit that is environmentally friendly because it reduces the amount of electrical power that utility companies need to supply for cooling purposes, and because the use of conventional space air conditioners, which utilize harmful coolants, is reduced.

Even still another object of the present invention is to provide a new evaporative cooler solar retrofit kit that is inexpensive and easy to install on new and existing evaporative coolers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
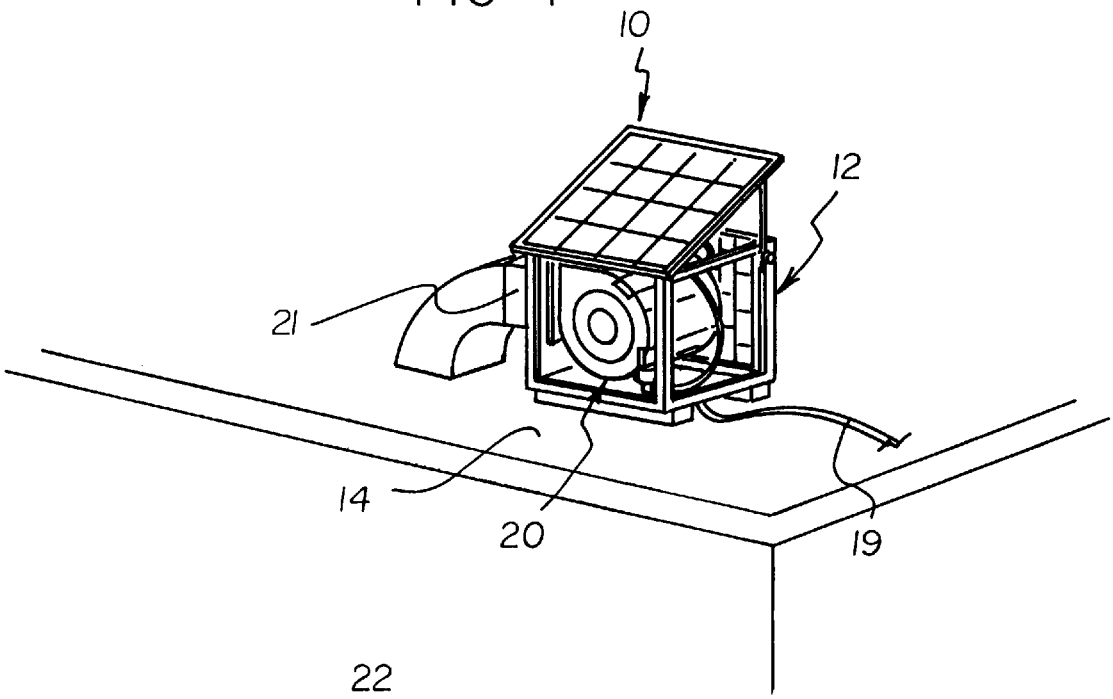
FIG. 1 illustrates an evaporative cooler mounted on a roof and which utilizes the new evaporative cooler solar retrofit kit according to the present invention.
Figure 2:
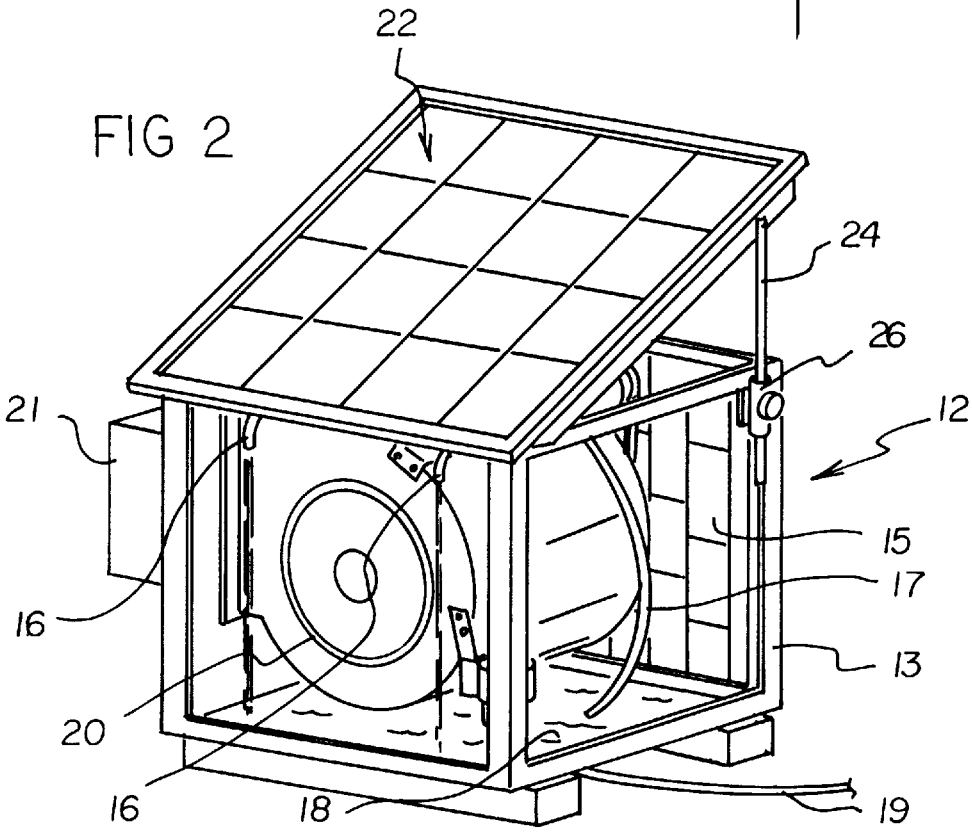
FIG. 2 is an elevated side perspective view of the evaporative cooler with retrofit kit.
Figure 3:
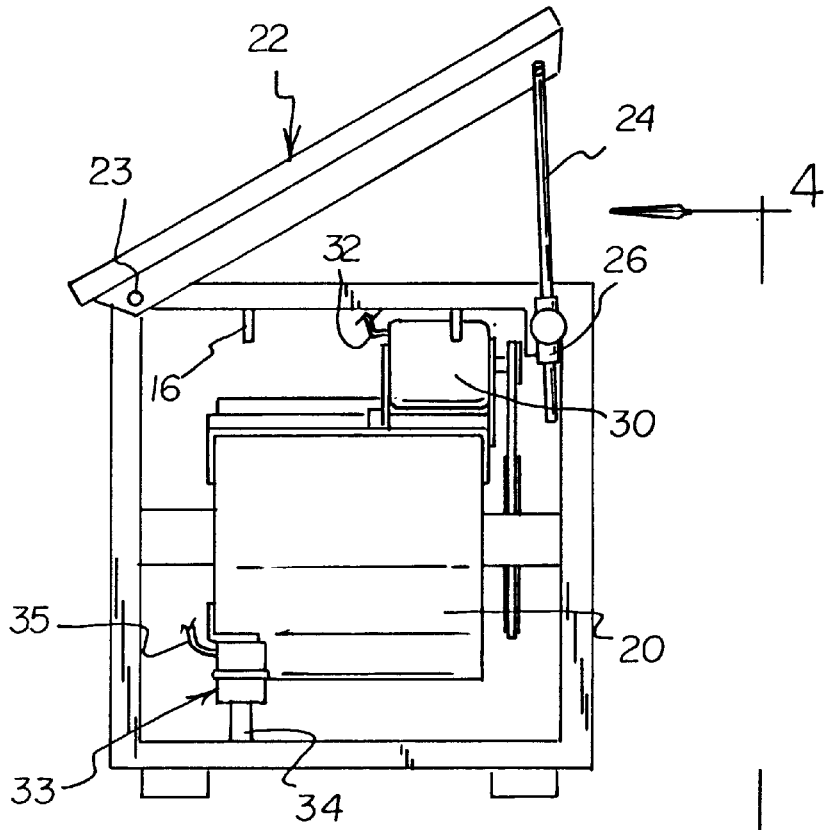
FIG. 3 is a side view of the present invention.
Figure 4:
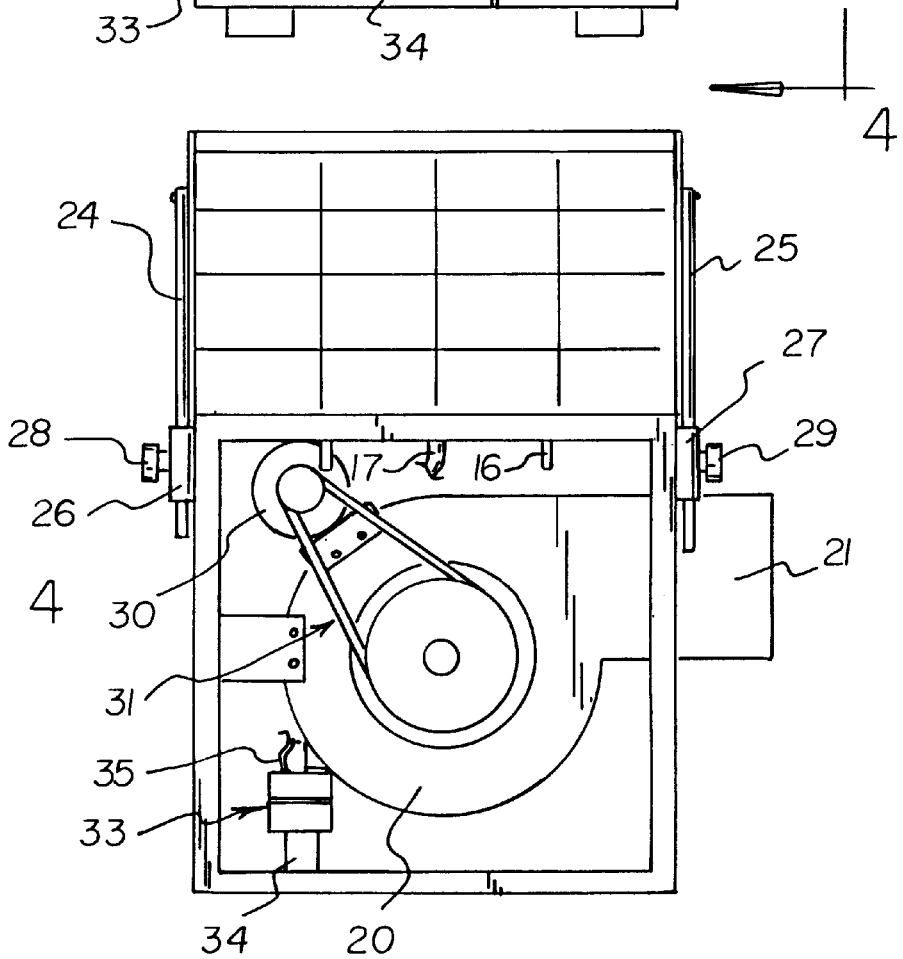
FIG. 4 is a view looking in the direction of line 4—4 of FIG. 3.

With reference now to the drawings, and in particular to FIGS. 1 through 4 thereof, a new evaporative cooler solar retrofit kit embodying the principles and concepts of the present invention and generally designated by the reference numeral 10 will be described.

As best illustrated in FIGS. 1 through 4, the evaporative cooler solar retrofit kit 10 is used in combination with a conventional evaporative cooler apparatus 12. As shown, the cooler apparatus 12 includes a housing 13 mounted on a roof 14 of a building, such as a house or an office building. The housing 13 includes four side walls, at least three of which have louver type openings (not shown). Adjacent each louvered opening, on the inside of the housing, is a pad 15 made of conventional materials. The pad 15 is impregnated with water using a conventional water cooling system including a spider 16 and a pump discharge line 17 centrally connected to the spider 16. The bottom of the housing is formed into a water reservoir 18 for collecting unevaporated water from the pads 15. Make-up water for replacing the water which evaporates is supplied through the line 19. Mounted inside the housing is a motor driven blower 20 for drawing air through the louvered sides of the housing. The blower 20, as is conventional, includes a pair of opposite, axial entrances and a tangential outlet duct 21 which extends through a side wall of the housing leading to the cooling system of the building. Thus, as shown, the evaporative cooler 12 is of the side-draft type, although the invention described herein can be used on an evaporative cooler of the down-draft type as well. A motor is normally used to drive the blower, while a motor driven pump is used to circulate water within the water cooling system. The evaporative cooler 12 thus far described is conventional, and further details thereof can found in the aforementioned U.S. Pat. No. 5,042,270, the entire disclosure of which is hereby incorporated by reference.

The kit 10 of the present invention includes a solar panel 22 which is connected along one edge thereof to the housing 13 by a hinge 23. A pair of cylindrical adjusting arms 24, 25 extend from the panel 22 and are disposed through respective sleeves 26, 27 attached to the housing forming part of an adjusting mechanism permitting manual adjustment of the angle of the solar panel. Locking knobs 28, 29 extend through the sleeves 26, 27, respectively, for engagement with the arms 24, 25 to selectively lock the arms in place. Thus by loosening the knobs, the angle of the solar panel can be adjusted so that sunlight can optimally impinge upon the panel. The knobs are then tightened, to lock the panel in place. The solar panel 22 produces electricity in a conventional manner, which is utilized to operate the evaporative cooler 12.

The kit 10 further includes a dc motor 30, such as a 12 V dc motor, which replaces the blower motor which is normally used on the evaporative cooler 12. The motor 30 is drivingly coupled to the blower 20 by a conventional belt and pulley drive 31 for driving the blower. The dc motor 30 is a high efficiency motor capable of being operated by the electricity produced by the solar panel. The motor 30 is electrically coupled to the solar panel through line 32.

Further, the kit 10 includes a dc motor driven pump 33 which replaces the pump motor and circulation pump normally used in the cooler 12. The pump 33 includes an inlet 34 in communication with the water reservoir 18, and an outlet (not shown) connected to the discharge line 17. The dc motor driving the pump 33 is a high efficiency motor capable of being operated by the electricity produced by the solar panel, to which it is electrically coupled by the line 35.

In use, an existing evaporative cooler is retrofitted by mounting the solar panel 12 to the housing of the cooler. The panel is adjusted so that it produces electricity from the sunlight impinging thereon. The existing blower motor in the cooler is replaced with the dc motor 30, and the motor 30 is electrically coupled to the solar panel to be operated by the electricity produced thereby. Additionally, the existing pump motor and circulation pump are replaced with the dc motor driven pump 33, which is electrically coupled to the solar panel so as to be operated by the electricity produced thereby. Thus the cooler 12 is completely operated from electricity produced by sunlight, thus eliminating the use of household electricity or commercial electric supplies.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of retrofitting an evaporative cooler of the type having a housing, a blower mounted within the housing and driven by a blower motor, a water cooling system within the housing, and a pump motor driving a circulation pump for circulating water within the water cooling system, the method comprising the following steps:

mounting a solar panel on the housing;

replacing the blower motor with a dc motor and electrically coupling the solar panel to the dc motor; and replacing the pump motor and circulation pump with a dc motor driven pump, and electrically coupling the solar panel to the dc motor driven pump.

2. The method as recited in claim 1, wherein the mounting step comprises connecting the solar panel to the housing using a hinge to permit adjustments of the solar panel relative to the housing.

3. The method as recited in claim 2, wherein the solar panel includes a pair of adjusting arms connected thereto, and wherein the mounting step further comprises engaging the adjusting arms with adjusting mechanisms on the housing so that the solar panel can be adjusted relative to the housing.

4. The method of claim 1 additionally comprising the step of providing a solar panel for mounting to the housing.

5. The method of claim 4 additionally comprising the step of connecting the solar panel to the housing so as to permit adjustments of the panel relative to the housing.

6. The method of claim 1 additionally comprising the step of connecting the solar panel to the housing by a hinge located along one edge of the housing.

7. The method of claim 1 additionally comprising the step of mounting a pair of adjusting arms extending from the solar panel and attaching adjusting mechanisms to the housing, the adjusting arms engaging the adjusting mechanisms to permit adjustment of the panel relative to the housing.

* * * * *